United States Patent [19]

Maas et al.

[11] Patent Number: 4,917,303

[45] Date of Patent: Apr. 17, 1990

[54] SNAP-IN TRIGGER

[75] Inventors: Wilhelmus J. J. Maas; Petrus L. W. Hurkmans, both of Someren, Netherlands

[73] Assignee: AFA Products, Inc., Forest City, N.C.

[21] Appl. No.: 249,374

[22] Filed: Sep. 26, 1988

[51] Int. Cl.[4] ..... B05B 9/04

[52] U.S. Cl. ..... 239/333; 74/527; 222/324; 222/383; 29/434; 29/453

[58] Field of Search ..... 222/383, 324; 239/333; 29/434, 453; 74/527

[56] References Cited

U.S. PATENT DOCUMENTS

| | | | |
|---|---|---|---|
| 3,768,734 | 10/1973 | Anderson, Jr. et al. | 239/333 |
| 4,153,203 | 5/1979 | Tada | 239/333 |
| 4,161,288 | 7/1979 | McKinney | 239/333 |
| 4,230,277 | 10/1980 | Tada | 239/333 |
| 4,241,853 | 12/1980 | Pauls et al. | 222/383 |
| 4,345,718 | 8/1982 | Horvath | 239/333 |
| 4,480,768 | 11/1984 | Martin | 222/341 |
| 4,489,890 | 12/1984 | Martin | 239/333 |
| 4,503,998 | 3/1985 | Martin | 222/341 |
| 4,558,821 | 12/1985 | Tada et al. | 239/333 |
| 4,815,663 | 3/1989 | Tada | 222/383 |
| 4,819,835 | 4/1989 | Tasaki | 222/383 |

*Primary Examiner*—Andres Kashnikow
*Assistant Examiner*—Christopher G. Trainor
*Attorney, Agent, or Firm*—Thomas R. Vigil

[57] ABSTRACT

The snap-in trigger for mounting in a trigger sprayer housing comprises a trigger which includes flexible members carrying pivotal mounting elements which mate with corresponding elements in a base, e.g., the sprayer housing. The flexible members are flexed towards each other during attachment of the trigger to the base, to allow easy mating of the pivotal mounting elements. The trigger also includes a flexible locking member which can be pivoted between a first position in which the locking members is spaced apart from the vicinity of the pivotal mounting elements, (e.g., during mating of the pivotal members while the flexible members are flexed together) and a second position in which the locking member is positioned directly between the flexible members in the vicinity of the pivotal mounting elements, preventing the flexible members from moving towards one another, and thus assuring proper mating configuration between the pivotal mounting members. The locking member also includes secondary locking means for securing it in the position between the flexible members.

27 Claims, 3 Drawing Sheets

SNAP-IN TRIGGER

BACKGROUND OF THE INVENTION

1. Field of the Invention

This invention relates to improvements in the construction and assembly of pivotal levers, generally, and to triggers for sprayers, in particular. The trigger of this invention can be integrally molded and includes structural features which permit virtually instantaneous snap-in attachment to a pivot base, such as to the housing of a sprayer, for secure, pivotal attachment.

Pivotal levers have widespread utility in industrial articles of manufacture, for example, as triggers in sprayers. Such levers should be pivotally attached securely to a base, such as, for example, a trigger to a sprayer housing. The design and construction of these levers is in response to a number of competing forces. For example, there is a need for low cost manufacture of the trigger element itself, for low cost trouble free assembly, i.e. attachment of the trigger to a spray head, for smooth operation, once assembled, and for long lasting trouble free operation.

All these considerations must be addressed effectively in order to provide the manufacturer of finished assemblies with a product of truly competitive cost, and the consumer user with a product of economic, completely satisfactory, trouble free construction.

2. Description of the Prior Art

There have been many suggestions for improving the design, construction, and assembly of such levers. For example, the McKinney U.S. Pat. No. 4,161,288 suggests retaining the trigger by providing a spiral chamber in the trigger into which pivot lugs on the sprayer housing can be maneuvered.

The Martin U.S. Pat. Nos. 4,480,768, 4,489,890, and 4,503,998 are sister patents which suggest providing the pivot attachment elements on flexible portions of both the trigger and sprayer housing, so that both of these sets of elements can flex during mating attachment, in order not to excessively damage the pivot lugs, etc. However, both sets of the flexible portions remain flexible, after attachment of the trigger to the sprayer, and these patents leave unresolved, the problem of dislodgement of the pivot lugs from their respective sockets, during forcible pivoting operation of the trigger, due to the flexibility of the lug-carrying portions of the trigger and the sprayer.

The Tada U.S. Pat. No. 4,153,203 suggests providing a lever (trigger) with flexible lateral walls carrying cylindrical pivot lugs, and addresses the problem of disengagement during pivotal operation by teaching to provide rigid "stopper boards" on the body which project from the body to bear against the insides of those flexible portions of the trigger which carry the pivot elements. This is purported to prevent the walls carrying the pivot elements from being thrown inward, thereby preventing unmating of the respective pivot lugs and sockets. This patent is silent, however, as to how, on one hand, the rigid "stopper boards" can, in the same configuration, allow assembly movement or positioning of the trigger unit to bring the pivot lugs into a pre-mating, coaxially aligned orientation with their corresponding sockets on the sprayer housing for mating of these pivotal linking elements without damage, and yet after mating, prevent the movement of these same flexible elements to that same pre-mating, coaxially aligned assembly position which would then allow disengagement of the pivot elements.

There is a need to provide the art with an economical snapin trigger which will provide secure, trouble free operation for the life of the sprayer, and which allows virtually instantaneous attachment to the sprayer housing, either manually or by machine.

SUMMARY OF THE INVENTION

The present invention provides a snap-in lever which will not be damaged during the assembly process to a sprayer, and which will maintain a secure assembled position to function properly for the life of the sprayer.

In accordance with a preferred aspect of the present invention, the lever, or trigger, is provided with three flexible members, e.g., panels. Two of these members, or panels are bilateral, and carry pivot structure for mating with corresponding elements on a base, or sprayer housing, and for providing pivotal attachment thereto. The third flexible member or panel constitutes a locking system, part of which is transverse to the bilateral panels, and is capable of flexing or hinging into two positions. The first position is one in which the third panel will not interfere with the motion of the pivot structure on the flexible bilateral panels prior to attachment to the base. The second position, the locking position, is one in which at least a portion of the third, i.e., transverse panel is positioned between the flexible bilateral panels, and prevents relative movement of the bilateral panels towards each other, thereby positively locking the pivot structure in proper position, by preventing disengagement of the mating pivot elements from the base.

Hence, as used herein, the term "locking" as applied to the flexible bilateral members or panels doesn't imply that the trigger is rendered immovable, but just that the pivot structure are secured in proper operating pivotal position.

In a more preferred aspect of this invention, the lever, or trigger, is a unitary molded element fashioned from strong, resilient, flexible polymer. In such a preferred embodiment, the third panel is molded in the first position referred to above, namely, in a position in which it will not interfere with the inward flexing of the pivot structure bearing bilateral panels. The third, locking, element is furthermore maintained in that open position during shipping, packaging, or other preassembly handling by means of integral, frangible, molded bridge webs extending between portions of the third panel, and respective adjacent portions of the bilateral panels. These integral webs are easily ruptured upon the application of sufficient force to accomplish hinging, or pivoting of the third panel into its locking position between the bilateral panels, during the final instant of assembly attachment of the lever to its base.

In addition, the third hinged panel, and the body of the lever is provided with a second locking arrangement for maintaining the third panel in the second, or locking position, in opposition to its tendency, due to molecular memory, to spring back to the first, open, molded position.

According to the invention, there is provided a trigger for mounting to a trigger sprayer housing having trigger pivot mounting means therein, said trigger comprising an elongate body having a top portion, said top portion including (a) first and second flexible side panels each carrying pivoting structure for mating with the trigger pivot mounting means and (b) flexible, movable locking means for locking said pivot structure in pivotal engagement with the trigger pivot mounting means when said locking means are moved relative to said side panels into a locking position.

Further according to the invention, there is provided a pivot assembly in a trigger sprayer comprising a trigger having an elongate body and a top portion and a sprayer housing having a recess, said assembly comprising trigger pivot mounting means in said recess and said top portion of said trigger body including (a) first and second flexible side panels each carrying pivoting structure for mating with the trigger pivot mounting means and (b) flexible locking means for locking said pivot structure in pivotal engagement with the trigger pivot mounting means when said locking means are moved relative to said side panels into a locking position.

DETAILED DESCRIPTION OF PREFERRED EMBODIMENTS

The broad aspects of the present invention are illustrated herein by reference to a specific preferred embodiment, namely, by reference to a trigger sprayer comprising a trigger and a sprayer housing. This is not intended to limit the scope of the invention, which is defined in the appended claims.

Figure 1:
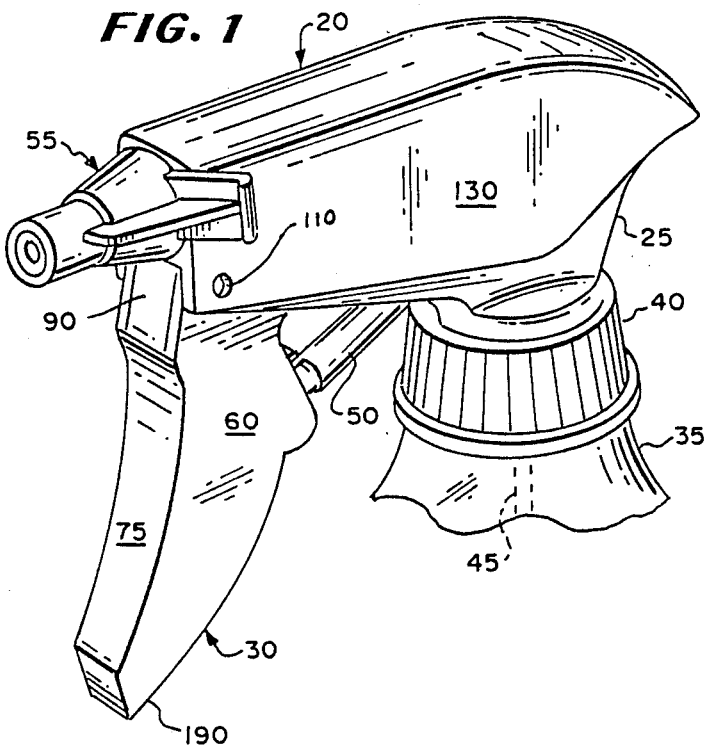
FIG. 1 is a perspective view of a trigger sprayer assembly attached to a container.

Considering FIG. 1, a trigger sprayer assembly 20 is shown comprising a sprayer housing 25, and a trigger 30. The trigger sprayer assembly 20 is shown attached to a container 35 by means of a screw cap 40, rotatably attached to the sprayer housing 25.

A dip tube 45, other elements 50 associated with a pumping mechanism, and a nozzle 55 are not part of the novel aspects of the present invention, and, for the purposes of this specification, are to be considered conventional. Hence, these structures, and other operational elements associated with the sprayer housing 25, apart from the novel lever, or trigger 30 and associated elements on the sprayer housing or base, will not be described in any further detail.

Figure 4:
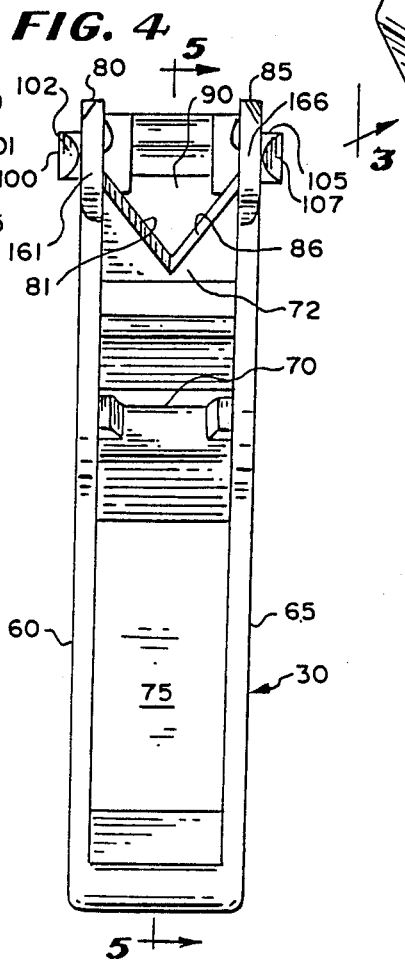
FIG. 4 is an inside elevational view of the trigger of FIG. 2 taken along line 4—4 of FIG. 2.
Figure 5:
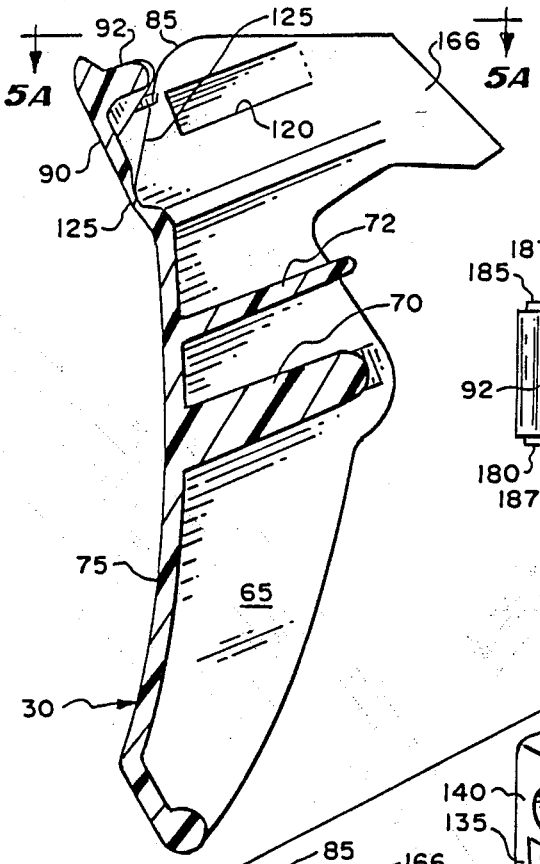
FIG. 5 is a cross sectional view of the trigger of FIG. 2 taken along line 5—5 of FIG. 4.
Figure 5A:
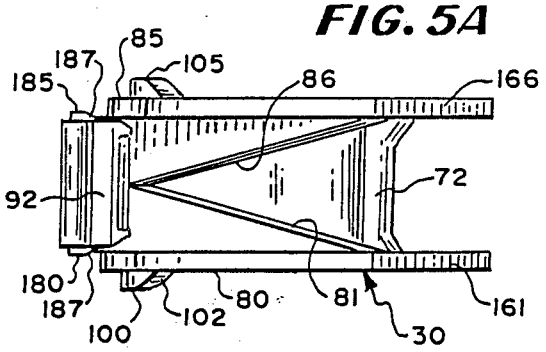
FIG. 5*a* is a top view of the trigger taken approximately along line 5*a*—5*a* of FIG. 5.

Turning now to the details of construction of the trigger 30, a preferred illustrated embodiment is an integral molded unit comprising side panels 60, 65 transversely joined by stiffener ribs 70, 72, and by front panel 75. (See FIGS. 4 and 9) Side panels 60, 65 include respective flexible end portions 80, 85, and the front panel 75 includes flexible locking end panel or flap 90. Side panels 60, 65 are also stiffened by respective ribs 81, 86. These ribs 81, 86 are preferably of a wedge shape, perhaps best illustrated in FIG. 5*a*, in order to maintain the correct spacing of side panels 60, 65 for assembly purposes, and yet do not interfere with the flexing of flexible end portions 80, 85 towards each other. It is noted that in the illustrated embodiment, the direction of placement of ribs 81, 86 is generally parallel to the axis of the flex or bend of side panels 60, 65 in the vicinity of flexible end portions 80, 85.

Flexible end portions 80, 85 carry pivot pins or lugs 100, and 105, respectively, for mating with respective, corresponding sockets 110 and 115 (see FIG. 6) in the sprayer housing 25. (In an alternative embodiment, not shown, the pivot lugs can be carried by the spray head 25, and the pivot sockets can be carried by the trigger, without departing from the spirit or scope of this invention.)

Figure 3:
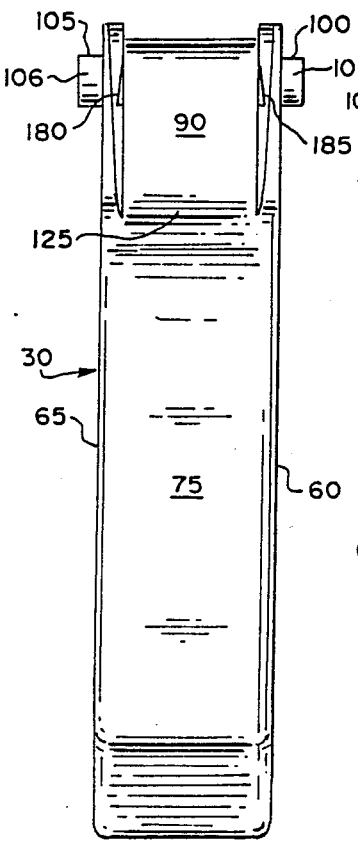
FIG. 3 is an outside elevational view of the trigger of FIG. 2, taken along line 3—3 of FIG. 2.

It is noted that pivot lugs 100, 105 are truncated, so that its walls include a round portion 101, 106, and an opposite ramp portion 102, 107. (See FIGS. 3 and 4.) The ramp portions 102, 107 are positioned to encounter the sprayer housing 25 during insertion of the trigger 30 into the sprayer housing 25, during assembly.

Figure 2:
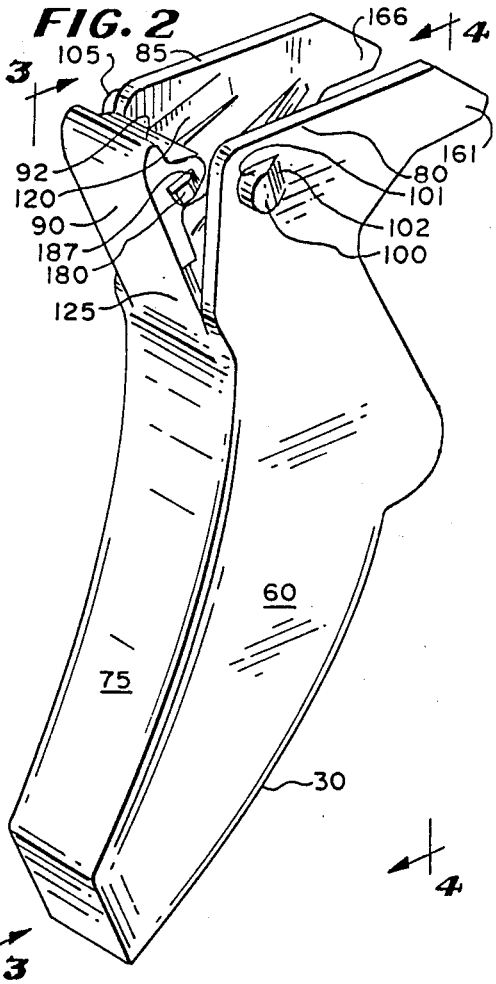
FIG. 2 is a perspective view of a detached unitary molded trigger constructed in accordance with the teachings of the present invention.

Two slots 120 (FIG. 2) are formed in the inner wall surface of the flexible portion 80, 85 of the side wall 60 and side wall 65, respectively, behind lugs 100, 105.

It is noted that in FIG. 1 the hinged end panel 90 of front panel 75 is positioned spaced-apart from the vicinity of pivot elements (lugs 100, 105) on the flexible end portions 80, 85 of the side panels 60, 65.

A flexible web bridge 125 or hinged area 125 of reduced thickness between the end panel 90 and front panel 75 maintain this configuration of the trigger 30 during the preinsertion and assembly in order to provide, at the moment of assembly insertion of the trigger 30 into the sprayer housing 25, flexible free ends 80, 85 which can be easily flexed towards each other. Should the hinged end panel 90 be forced out of the "open" configuration shown in FIG. 1, and into the "locking" configuration shown in FIG. 11, prior to insertion assembly of the trigger 30 to the sprayer housing 25, it would be impossible to flex the free end portions 0, 85 inwardly and thus pivot lugs 100, 105 would be severely damaged.

Figure 6:
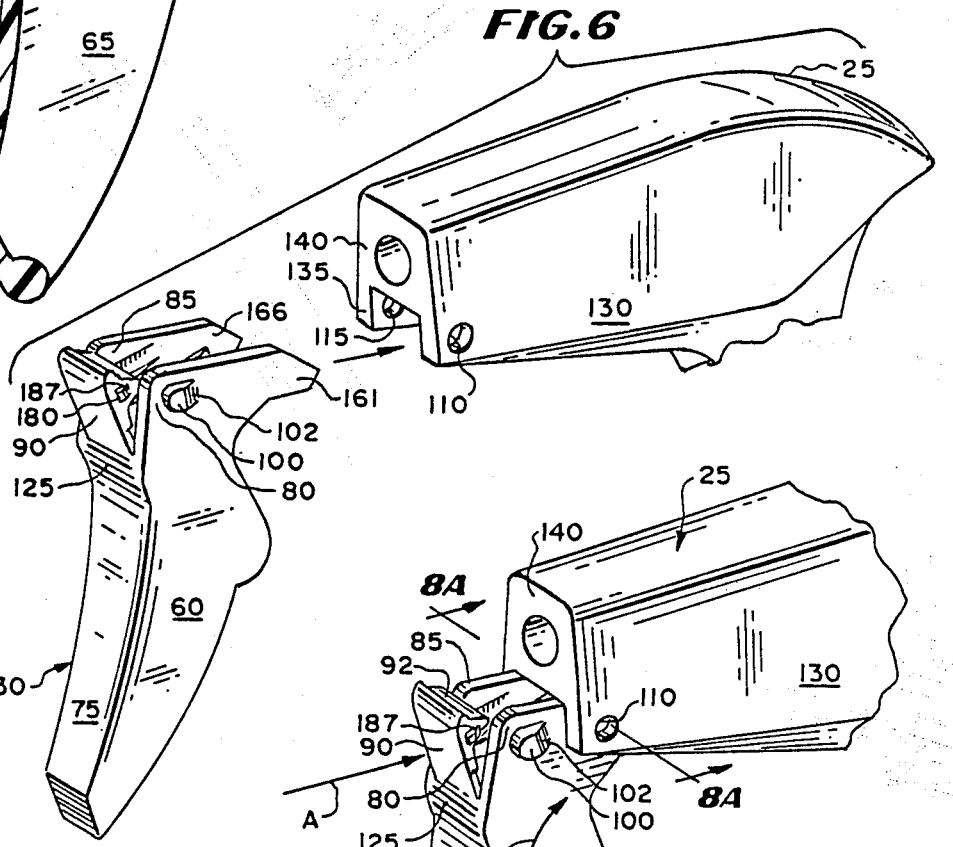
FIG. 6 is a perspective view of the trigger and a sprayer housing illustrating the alignment of the trigger and the sprayer housing, prior to assembly insertion of the trigger into the sprayer housing.

Referring now to FIG. 6, trigger 30 is shown aligned for insertion, during assembly, into the sprayer housing 25. Both sockets 110, 115 are visible in FIG. 6, and are shown located in respective rigid side panels 130, 135. Fixed maintenance of rigid panels 130, 135 in the exact spaced-apart dimensions shown, is assisted by integral end face 140 of sprayer housing 25 and recess wall 147 which extends between panels 130, 135, and which assist in preventing even the slightest movement of side panels 130, 135 to or from each other.

Figure 7:
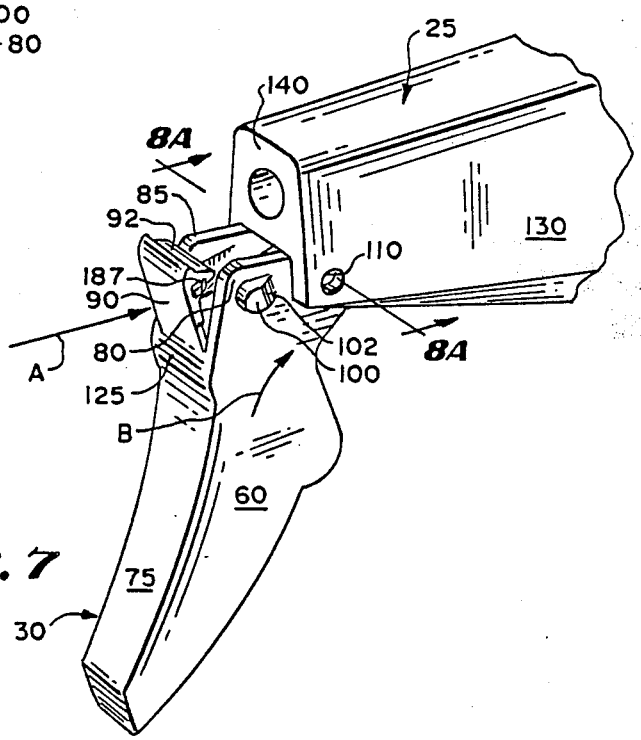
FIG. 7 is a perspective view illustrating partial insertion of the trigger into the sprayer housing.
Figure 8A:
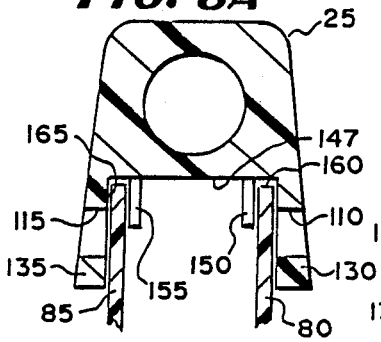
FIGS. 8*a*, 8*b*, and 8*c* are fragmentary, cross sectional views of the trigger and the sprayer housing taken along line 8—8 of FIG. 7, and illustrates sequential positions of elements during the mating insertion of the trigger into the sprayer housing or base.
Figure 8B:
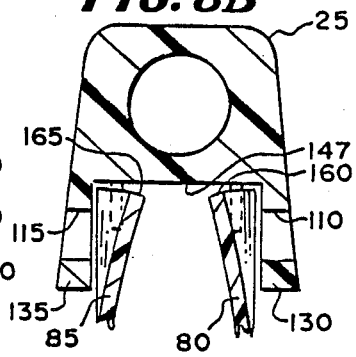
Figure 8C:
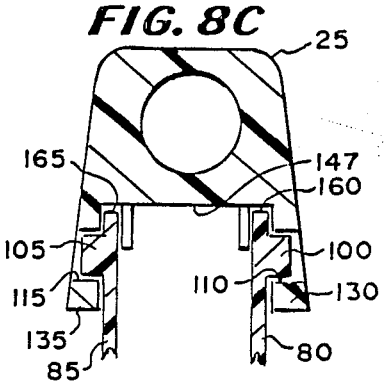

Referring to FIG. 7, trigger 30 is shown partially inserted between spray head panels 130, 135, and FIGS. 8*a*, 8*b*, and 8*c* show relationships between elements during the continuing insertion of the trigger 30 into the sprayer housing 25.

In FIG. 7, the significance of ramp portions 102, 107 of pivot lugs 100, 105 becomes clear. Hence, as the trigger 30 is moved in the general direction of the arrow, so are the ramp portions 102, 107 of lugs 100, 105 which first encounter the ends of sidewalls 130, 135. Continued inWard insertion of the trigger 30 into the recess 145, defined by wall 147, sidewalls 130, 135 and end wall 140 and associated parts of the sprayer housing 25, causes the "ramping-in" of the flexible end panels 80, 85 towards each other, allowing lugs 100, 105 to pass between rigid sidewalls 130, 135 of the sprayer housing 25, without damage.

Alternatively, manual or machine pressure against the outer surfaces of flexible ends 80, 85 in the vicinity of lugs 100, 105 causes the inward flexing which will allow lugs 100, 105 to clear and enter recess 145, and to travel within recess 145 easily.

Also, as an alternative, the trigger 30 can be mated with the sprayer housing 25 by insertion into recess 145 from other directions, for example, along the path indicated by the arrow marked "B" in FIG. 7.

Figure 9:
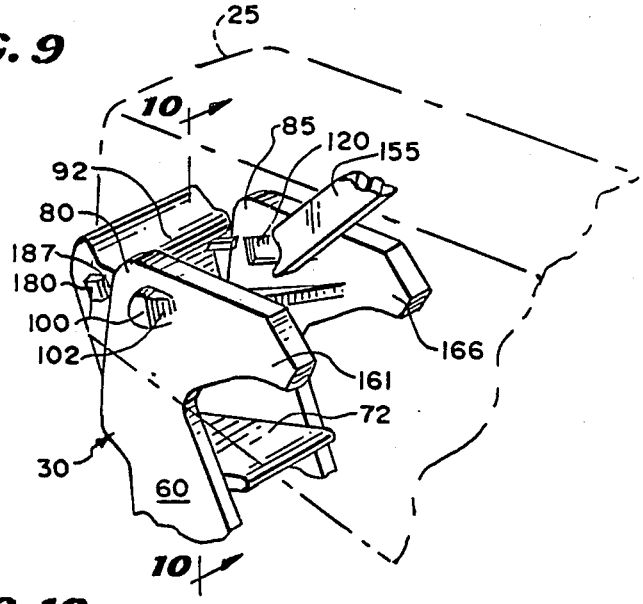
FIG. 9 is a perspective, cut-away view of the top of the trigger and shows the trigger in fully inserted position, pivotally attached to the sprayer housing or base.

FIG. 8*a* shows the initial relationships, as the trigger 30 is first inserted, along the arrow marked "A" in FIG. 7, and to the extent shown in FIG. 7. In this illustration, the ends of flexible bilateral wall panels 80, 85 are travelling within the recess 145 formed by rigid side panels 130, 135 and connecting inner wall 147 of sprayer housing 25. Cradle arms 150, 155 define respective rigid projections extending from wall 147 of the sprayer housing 25 into the recess 145 region between the rigid sidewalls 130, 135, and are spaced apart from the rigid sidewalls 130, 135 to define respective slots 160, 165. (A cradle arm is also illustrated in FIG. 9.)

In FIG. 8*a* the respective ends 161, 166 of trigger wall panels 60, 65 are shown entering respective slots 160, 165 defined by bilateral cradle arms 150, 155.

It is at this point that it is important, for high speed machine assembly, for example, that the spaced-apart dimension of the ends 161, 166 be accurate to match the spaced-apart dimension of respective slots 160, 165, and it is noted that ribs 81, 86 help assure that accuracy at the moment of insertion of the trigger 30 into recess 145 of the sprayer housing 25.

FIG. 8*b* illustrates the limited inward flexing of the flexible side panel portions 80, 85 as pressure against ramp portions 102, 107 of respective lugs 100, 105 wedge flexible panels 80, 85 inwardly towards each other, thereby allowing the lugs 100, 105 to clear rigid sidewalls 130, 135 and move unharmed between rigid sidewalls 130, 135.

The positioning of the cradle arm, or stop arm elements 150, 155 adjacent sidewalls 130, 135 to define channels or slots 160, 165 to limit the inward flex of the trigger flexible sidewalls 80, 85 is optional.

However, this arrangement of the arms 150, 155 does provide a more positive "snap" when the respective pivot elements 100, 105, and 110, 115 are coaxially aligned and mated, by biasing sidewalls 80, 85 toward the mated position, as shown in FIG. 8*c*. These cradle arms, in the illustrated position, thereby facilitate achievement of the spaced-apart dimension between flexible panel portions 80, 85, for the ready entry of hinged panel 90 therebetween, after mating of respective lugs 100, 105 with respective sockets 110, 115, for the locking configuration shown in FIG. 8*c*.

Cradle arms 150, 155 also serve another important function which will be described more fully in connection with the description of FIG. 11; namely, they serve as stop means to prevent the hinging motion of the hinged end panel 90 beyond the proper locking position between flexible panels 80, 85 in the vicinity between pivot lugs 100, 105.

In FIG. 9, the relative position of only one cradle arm 155 is shown for the purpose of simplifying and clarifying the illustration of the positioning of the trigger 30 in pivotally mated position with respect to the sprayer housing 25. The relationships inherent in FIG. 9 are more fully developed immediately hereinafter with the aid of the cross sectional views of FIG. 10 and 11.

Figure 10:
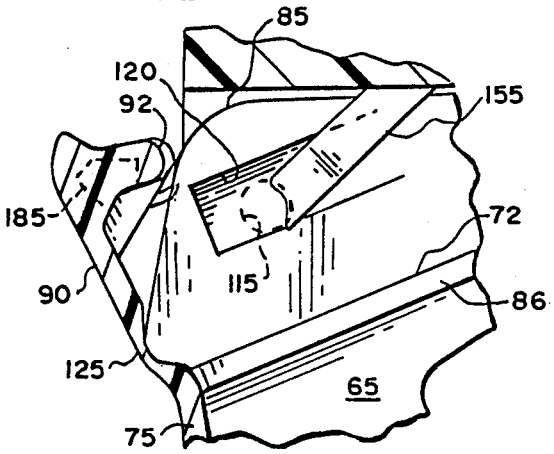
FIG. 10 is a fragmentary cross sectional view of the trigger and sprayer housing taken along line 10—10 in FIG. 9, illustrating the attached, unlocked configuration of the trigger with the third, or hinged panel shown in the open position.

As shown in FIG. 10, the hinged end panel 90, and its columnar rib 92 are positioned spaced-apart from the vicinity of the pivot elements, e.g. pivot lug 105, pivot socket 115, and the integral bridge web 125 maintains the hinged end panel 90 in its "open" configuration. Flexible panels 80, 85 can be flexed inwardly towards each other while the hinged, locking end panel 90 is in this position.

Figure 11:
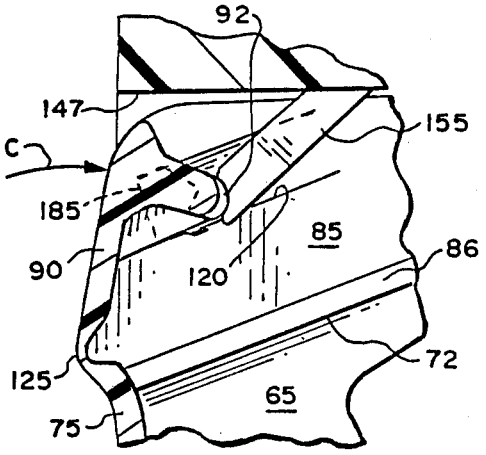
FIG. 11 is a fragmentary cross sectional view of the trigger and sprayer housing as shown in FIG. 10, except that the third, hinged panel is shown moved into its locking position.

FIG. 11 illustrates the configuration prevailing after end panel 90 is moved to a locking position in which the columnar rib 92 is positioned between flexible end walls 80, 85 in the vicinity of the pivot elements, e.g. pivot lugs 100, 105. It is clear from a comparison of FIG. 10 and FIG. 11, that the slots 120 on the respective inner faces of flexible panels 80, 85 of side walls 60, 65 and detents 180, 185 extending from the respective ends of columnar lock rib 92 serve as a secondary locking arrangement to secure the flexible hinged, locking, end panel 90 in its locking position to provide the primary locking function, namely, keeping flexible panels 80, 85 apart to such an extent that lugs 100, 105 will never leave corresponding respective sockets 110, 115 during operation, or otherwise.

The end panel 90 is hinged by the reduced thickness hinge area 125 between the panel 90 and the front panel 75. During assembly or use of the trigger sprayer, cracks will sometimes occur in the hinge area 125. However, with the locking end panel 90 locked in place, such cracks do not adversely affect the trigger 30 or the functioning thereof.

Detents 180, 185 are also tapered, or "ramped" at 187 to facilitate their entry between panel ends 80, 85, during the locking movement indicated by the arrow c in FIG. 11 and into respective retaining slots 120. The retaining slots 120 serve to lock the detents 180, 185 in place thereby to lock the end panel 90 in the assembled positions.

Thus, the hinged, locking end panel 90 is shown in its open, unlocked configuration in FIGS. 2–10, and is shown in its locked configuration in FIGS. 1 and 11.

The role of the cradle arms e.g. 150, namely, preventing overshoot of the flexible, locking end flap 90 beyond the proper locking configuration is clear from FIG. 11.

Hence, attachment of the snap-in lever, or trigger 30 of this invention to a base or sprayer housing 25, in accordance with this invention, is virtually instantaneous.

Mating of the trigger 30 and the sprayer housing 25 can take place by movement of the trigger 30 into recess 145, from any appropriate direction, e.g. along the lines identified by Arrow A, or Arrow B, in FIG. 9.

Positioning of the trigger 30 into the recess 145 approximately as shown in FIG. 9, and moving the trigger relatively towards the sprayer housing 25 along the path indicated by the arrow "A" in FIG. 7 causes the ends 161, 166 of trigger side panels to enter slots 160, 165, respectively, and tapered portions 102, 107 of lugs 100, 105 to engage the ends of rigid sidewalls 130, 135. Continued application of pressure in the mating direction results in inward flexing of the trigger side panel portions 80, 85 towards each other. This allows the lugs 100, 105 to easily pass between sidewalls 130, 135 and to be moved easily into a position of coaxial alignment with sockets 110, 115. The lugs 100, 105 then "snap" into sockets 110, 115 to pivotally attach the trigger 30 to the sprayer housing 25. Pushing hinged locking end panel 90 inward, e.g. along the arrow in FIG. 11, results in the looking of the pivot lugs 100, 105 and sockets 110, 115 in the mating, pivoting configuration, and also automatically secures the hinged end panel 90 into that locking configuration.

Hence, this assembly operation can be done almost instantaneously by hand, or by machine.

Operation of this lever system by forcibly moving the unattached end of the trigger 30 towards the sprayer housing 25, brings the rounded portions 101, 106 of the lugs 100, 105 to bear against the opposing rounded bearing surfaces of sockets 110, 115 and causes movement of the pump mechanism 50 with mechanical advantage. Hence, providing for truncated portions 102, 107 of pivot lugs 100, 105 doesn't adversely affect the smooth bearing cooperation between the lugs 100, 105, and their corresponding respective sockets 110, 115. Nor does that cause any tendency for the pivot lugs 100, 105 to jump or wedge out of the sockets 110, 115, because it is only the rounded surfaces 101, 106 of the lugs 100, 105 which will bear against the bearing surfaces of sockets 110, 115, during forcible, pivoting operation of the trigger. Note that if desired the truncated ramp surfaces 102, 107 can extend angularly transversely of the trigger 30 and rearwardly toward the sprayer housing 25 or directly upwardly toward the housing 25 on or at an inclined angle to the vertical, e.g., 45 toward the housing depending on the choice of direction of insertion of the top portion of the trigger 30 into the sprayer housing 25. One preferred direction of insertion is shown by the arrow B in FIG. 7. In this assembly method, the trigger 30 is first located a few millimeters below and in front of the housing 25. Then, the ramp 102, 107 on pivot lugs 100, 105 are moved angularly upwardly past the inside corner of the panels 130, 135 into the rcess 147.

In addition, the close abutment of surfaces of the trigger side panels 60, 65 to opposing surfaces of rigid panels 130, 136 of spray head 25, as well as the presence of ends 161, 166 of side panels 60, 65 in slots 160, 165, and the stiffener ribs 81, 86 on side panels 60, 65, all cooperate to prevent wobble or twisting of trigger 25, after assembly, when twisting, or side-to-side forces are applied to the free end of trigger 25, and to reduce the forces applied on pivot lugs 100, 105.

From the foregoing description, it will be apparent that the pivot assembly of the trigger 30 to the sprayer housing 25 provides a number of advantages, some of which have been described herein and others of which are inherent in the assembly. Furthermore, it will be apparent that modifications can be made to the pivot assembly without departing from the teachings of the invention. Accordingly, the scope of the invention is only to be limited as necessitated by the accompanying claims.

We claim:

1. A pivot assembly comprising a base and a pivot arm and including pivot means for pivotally attaching said pivot arm to said base; said pivot means including respective mating elements on said base and said pivot arm, said mating elements comprising individual elements of opposing respective mating pairs of bearing sockets and pivot pins; said pivot arm comprising parallel spaced-apart flexible members each carrying one of said respective mating elements, said flexible members being adapted to flex sufficiently to allow said mating elements to enter into mating relationship with their pivot means counterparts on said base without substantial deformation of said mating elements; said pivot arm also comprising an integral hinged member having first locking means, said hinged member being adapted to hinge into a plurality of positions, a first of said positions being in an open configuration in which said first locking element is positioned away from the position of said mating elements, and a second of said positions being in a configuration in which a portion of said first locking means is positioned between said flexible members; said first locking means in said second position being adapted to maintain said mating elements in a mating configuration by restricting said flexible members against relative movement with respect to each other in the vicinity of said mating elements; said pivot arm including second locking means for securing the hinged member in said second position.

2. The assembly of claim 1 including cradle means fixed to said base, and positioned for stopping hinging movement of said hinged member beyond said second position.

3. A pivot assembly comprising a base and a pivot arm and including pivot means for pivotally attaching said pivot arm in a recess in said base; said pivot means including respective mating elements on said pivot arm, and in a recess in said base, said mating elements comprising individual elements of opposing respective mating paris of bearing sockets and pivot pins; said pivot arm comprising parallel spaced-apart flexible wall members each having leading ends adapted for positioning within said recess and each flexible wall member carrying one of said respective mating elements, said flexible wall members being adapted to flex toward each other sufficiently to allow said mating elements to enter into mating relationship with their pivot means counterparts in said recess on said base without substantial deformation of said mating elements; said pivot arm also comprising an integral hinged member having first locking means comprising a spacer, said hinged member being adapted to hinge into a plurality of positions, a first of said positions being in an open configuration in which said spacer is positioned away from the position of said mating elements, and a second of said positions being in a configuration in which said spacer is positioned to engage said flexible members; said first locking means in said second of said positions being adapted to maintain said mating elements in a mating configuration by restricting said flexible members against relative movement toward each other in the vicinity of said mating elements; said pivot arm including second locking means for securing the hinged member in said second of said positions.

4. The pivot assembly of claim 3 including cradle means fixed to said base, and positioned for stopping hinging movement of said hinged member beyond said second position.

5. The pivot assembly of claim 4 wherein said cradle means comprises a projection which extends from the base into said recess and which projection is spaced apart from adjacent walls of said recess to define a slot therebetween, said slot being positioned to receive a leading end of a respective one of said flexible wall members as said trigger is being inserted into said recess during assembly, said leading ends being sufficiently long to provide insertion of a respective one of said leading ends into said slot before said pivot means on said trigger encounter opposing surfaces at the entry of said recess, and whereby, when said flexible wall members are flexed closer to each other in order to move corresponding pivot means into mating configuration, the positioning of said leading end in said slot biasing said flexible wall member into the fully spaced-apart position in which the pivot means re properly mated, thereby causing the corresponding pivot means to snap into mating configuration when coaxially aligned, and thereby moving the flexible wall member, when such snap-in occurs, to be positioned sufficiently apart from each other to permit hinging of the locking element in between the flexible wall members.

6. In a trigger sprayer assembly comprising a sprayer housing and a trigger for controlling the trigger sprayer operation, or for generating pressure to generate a spray operation, said trigger being pivotally mounted in a recess in the sprayer housing by respective mating means comprising opposing mating pairs of bearing sockets and pivot pins in said trigger and in said recess in said sprayer housing, the improvement in which: said trigger includes parallel spacedapart, flexible wall members each having free ends and each carrying one of said respective mating elements, said flexible wall members being adapted to flex towards each other to allow mating elements on said trigger to enter into mating relationship with pivot means counterparts on said sprayer housing without substantial deformation of any of said mating elements; said trigger also comprising a hinged member having a spacer, said hinged member being adapted to hinge into a plurality of positions, a first of said positions being in a configuration in which said spacer is positioned to allow said parallel opposed flexible members sufficient motion towards each other to enter into a pivotally joined mating position with said spray head base, and a second of said positions being in a closed configuration in which said spacer is positioned between said mating elements; said spacer in second position being adapted to maintain said mating pivot elements in a mating configuration by restraining said flexible members against relative movement towards each other; said trigger including locking means for securing the hinged member in said second position.

7. The trigger sprayer assembly of claim 6 including stop means fixed to said base and positioned for stopping inward movement of said hinged member beyond said second position.

8. The trigger sprayer assembly of claim 7 wherein said stop means comprises a projection which extends from the sprayer housing into said recess and which is spaced apart from adjacent walls of said recess to define a slot, said slot being positioned to receive a leading end of said respective flexible wall member as said trigger is being inserted into said recess during assembly, said leading end being sufficiently long to provide engagement of said leading end in said slot before said pivot means enter said recess, and whereby, when said flexible wall members are flexed closer to each other in order to move mating pivot means into said recess towards said mating configuration, the positioning of said leading end into said slot bias said flexible wall into the fully spaced-apart position in which the pivot means are properly mated, thereby causing corresponding pivot means to snap into mating configuration when coaxially aligned, and thereby moving the flexible wall member, when such snap-in occurs, to be positioned sufficiently apart from each other to permit hinging of the spacer into a position in between the flexible wall members.

9. The trigger sprayer assembly of claim 6 wherein said opposed inwardly flexible wall members each carry respective coaxial outwardly extending pivot pins adapted to mate with respective coaxial corresponding sockets in a recess of the sprayer housing; said spacer element includes an end post portion which, when said hinged member is in said second position, is coaxial with said pins and sockets, and fits snugly between said opposed flexible wall members.

10. The trigger sprayer assembly of claim 6 wherein said locking means comprises first detent means on said hinged member, which first detent means are positioned to cooperate with corresponding second detent means located on said flexible members.

11. A snap-in trigger for incorporation into a recess in a cooperating base member which has pivot means in said recess for pivotally securing said trigger in said base member, said trigger including: parallel spaced-apart flexible members each having a leading end, and each carrying one mating element for pivotally mating with said pivot means in said base member, said flexible members being adapted to flex inwardly sufficiently to allow entry of the flexible wall members into said recess without deformation of said pivot means, and to allow said mating elements to enter into mating relationship with pivot means counterparts on said base member without substantial deformation of said mating elements or said pivot means; said trigger also comprising an integral hinged member having a spacer element, said hinged member being adapted to hinge into a plurality of positions, a first of said positions being in an open configuration in which said spacer element is positioned away from the position of said pivot means on said parallel flexible wall members, and a second of said positions being in a closed configuration in which said spacer element is snugly positioned between said flexible members in the vicinity of said mating elements; said spacer in second position being adapted to maintain said mating pivot elements in a mating configuration by restraining said flexible members against relative movement toward each other in the vicinity of the mating elements; said trigger including locking means for securing the hinged member in said second position.

12. The trigger of claim 11 including cradle means fixed to said base positioned for stopping inward movement of said hinged member beyond said second position.

13. The trigger of claim 11 wherein said locking means comprises first detent means on said hinged member, which detent means cooperate with corresponding second detent means on said flexible members.

14. The trigger of claim 11 wherein said opposed inwardly flexible members each carry respective coaxial outwardly extending pivot pins; said spacer element includes a columnar portion which, when said hinged member is in said second position, is coaxial with said pins and fits snugly between said opposed flexible members.

15. A trigger for quick snap-in assembly attachment into a trigger sprayer housing, which sprayer housing has a recess, and pivot means in said recess for pivotally securing said trigger to said sprayer housing in said recess, said trigger comprising: parallel spaced-apart inwardly flexible wall members each having a leading end, and each carrying one mating element for pivotally mating with respective pivot means in said sprayer housing, said flexible wall members being adapted to flex towards each other sufficiently to allow said mating elements to enter into said recess without deforming said mating elements, and to move into a position for mating relationship with pivot means counterparts in said recess without substantial deformation of said mating elements or said pivot means; said trigger also comprising an integral hinged member having a spacer element, said hinged member being adapted to hinge into a plurality of positions, a first of said positions being in an open configuration in which said spacer element is positioned away from the position of said pivot means on said flexible wall members, and a second of said positions being in a closed configuration in which said spacer element is positioned between said flexible members; said spacer in said second position being adapted to maintain said mating pivot elements in a mating configuration by restraining said flexible members against relative movement toward each other in the vicinity of said mating elements; said trigger including locking means for securing the hinged member in said second position.

16. The trigger of claim 15 wherein the mating element includes pivot lugs on each of said flexible wall members, said lugs having a portion thereof truncated to provide a ramp positioned to engage the walls of said recess in said base to forcibly cause the flexible wall members to flex toward each other as the trigger is inserted into said recess.

17. The trigger of claim 15 wherein said inwardly flexible members each carry respective coaxial outwardly extending pivot pins adapted to mate with respective coaxial corresponding sockets in said body portion; said spacer element includes a columnar portion which, when said hinged member is in said second position, is coaxial with said pins and sockets, and fits snugly between said opposed flexible members.

18. The trigger of claim 15 wherein said locking means comprises first detent means on said hinged member, which first detent means cooperate with corresponding second detent means on said flexible members.

19. The trigger of claim 15 wherein said hinged member is an integral molded piece in which said hinged element is manufactured to include an integral, easily frangible bridge maintaining said hinged element in the first, open position.

20. A unitary trigger for quick snap-in assembly attachment into a trigger sprayer housing, which sprayer housing has a recess, and pivot means in said recess for pivotally securing said trigger to said sprayer housing in said recess, said trigger comprising: a unitary element molded from polymer comprising parallel spaced-apart inwardly flexible wall members each having a leading end, and each having one mating element for pivotally mating with respective pivot means in said sprayer housing, said flexible wall members being adapted to flex towards each other sufficiently to allow said mating elements to enter into said recess without damage to said mating elements, and to move into a position for mating relationship with pivot means counterparts in said recess without damage of said mating elements or said pivot means; said unitary trigger also comprising an integral flexible locking member having a spacer element, said locking member being adapted to move into a plurality of positions, a first of said positions being in an open configuration in which said spacer element is positioned away from the position of said pivot means on said flexible wall members, and a second of said positions being in a closed configuration in which said spacer element is positioned between said flexible members, said spacer in said second position being adapted to maintain said mating pivot elements in a mating configuration by restraining said flexible members against relative movement toward each other in the vicinity of said mating elements; said trigger including second locking means for securing the locking member in said second position.

21. The trigger of claim 20 wherein the mating element includes pivot lugs on each of said flexible wall members, said lugs having a portion thereof truncated to provide a ramp positioned to engage the walls of said recess in said base to forcibly cause the flexible wall members to flex toward each other as the trigger is inserted into said recess.

22. The trigger of claim 20 wherein said inwardly flexible members each carry respective coaxial outwardly extending pivot pins adapted to mate with respective coaxial corresponding sockets in said sprayer housing; said spacer element includes a columnar portion which, when said hinged member is in said second position, is coaxial with said pins and sockets, and fits snugly between said opposed flexible members.

23. The trigger of claim 20 wherein said locking means comprises first detent means on said locking member, which first detent means cooperate with corresponding second detent means on said flexible members.

24. The trigger of claim 20 wherein said hinged member is an integral molded piece in which said locking element is manufactured to include an integral, easily frangible bridge maintaining said locking element in the first, open position.

25. A trigger for mounting to a trigger sprayer housing having trigger pivot mounting means therein, said trigger comprising an elongate body having a top portion, said top portion including (a) first and second flexible side panels each carrying pivoting structure for mating with the trigger pivot mounting means and (b) flexible, movable locking means for locking said pivot structure in pivotal engagement with the trigger pivot mounting means when said locking means are moved relative to said side panels into a locking position.

26. A pivot assembly in a trigger sprayer comprising a trigger having an elongate body and a top portion and a sprayer housing having a recess, said assembly comprising trigger pivot mounting means in said recess and said top portion of said trigger body including (a) first and second flexible side panels each carrying pivoting structure for mating with the trigger pivot mounting means and (b) flexible, movable locking means for locking said pivot structure in pivotal engagement with the trigger pivot mounting means when said locking means are moved relative to said side panels into a locking position.

27. The method of pivotally attaching a trigger to a trigger sprayer housing, said trigger having flexible side panel portions carrying first pivot mounting means, said sprayer having a recess with second pivot mounting means, said first and second pivot mounting means being adaptable for mating with each other to provide pivotal attachment of said trigger to said sprayer housing, said method comprising the steps: (a) providing on said trigger a flexible spacer element including a locking member, said spacer element being adapted to move said locking member into a plurality of positions, a first of said positions being in an open configuration in which said spacer element is positioned away from the position of said first pivot means on said flexible side panel portions, and a second of said positions being in a closed configuration in which said spacer element is positioned between said flexible side panel portions, said locking member in said second position being adapted to maintain said mating first pivot means in a mating configuration with said second pivot means by restraining said flexible members against relative movement toward each other in the vicinity of said mating elements, said spacer element also comprising secondary lock means for securing said locking element in said second position; (b) inserting said first means into said recess by flexing said flexible side panel portions towards each other, and moving said first pivot mounting means into coaxial alignment with said second mounting means, and mating said first and second pivot mounting means; (c) moving said spacer element to said second position in which said locking element is positioned between said flexible side panel portions; and (d) securing said secondary lock means for securing said locking element in said second position.

* * * * *

UNITED STATES PATENT AND TRADEMARK OFFICE

CERTIFICATE OF CORRECTION

PATENT NO. : 4,917,303

DATED : April 17, 1990

INVENTOR(S) : Wilhelmus J. J. Maas and Petrus L. W. Hurkmans

It is certified that error appears in the above-identified patent and that said Letters Patent is hereby corrected as shown below:

Column 2, line 4 "snapin" should be --snap-in--.

Column 4, line 59 "0" should be --80--.

Column 5, line 14 "inWard" should be --inward--.

Column 7, line 19 "looking" should be --locking--.

Column 7, line 53 "rcess" should be --recess--.

Column 8, line 44 "paris" should be --pairs--.

Column 9, line 21 "re" should be --are--.

Column 9, line 36 "spacedapart" should be --spaced-apart--.

Signed and Sealed this

Sixth Day of April, 1993

*Attest:*

STEPHEN G. KUNIN

*Attesting Officer*

*Acting Commissioner of Patents and Trademarks*